US005261651A

United States Patent [19]

Ishida

[11] Patent Number: 5,261,651

[45] Date of Patent: Nov. 16, 1993

[54] FEEDING AND DELIVERY STRUCTURE FOR CUTFORM MEDIA IN PRINTER

[75] Inventor: Hiroshi Ishida, Nagano, Japan

[73] Assignee: Seiko Epson Corporation, Tokyo, Japan

[21] Appl. No.: 36,836

[22] Filed: Mar. 25, 1993

Related U.S. Application Data

[63] Continuation of Ser. No. 803,040, Dec. 6, 1991, abandoned.

[30] Foreign Application Priority Data

Jan. 29, 1991 [JP] Japan ..... 3-008973

[51] Int. Cl.[5] ..... B65H 5/00; B65H 1/00

[52] U.S. Cl. ..... 271/3; 271/9; 271/171

[58] Field of Search ..... 271/3, 9, 171; 400/625

[56] References Cited

U.S. PATENT DOCUMENTS 4,511,904 4/1985 Takahashi et al. ..... 271/171
4,569,586 2/1986 Koyama ..... 271/9
4,747,718 5/1988 Shimizu .
4,789,258 12/1988 Gomoll et al. ..... 271/9
4,790,524 12/1988 Murakami et al. ..... 271/9
4,900,173 2/1990 Okamura ..... 271/9
5,069,435 12/1991 Mizutani ..... 271/3

FOREIGN PATENT DOCUMENTS 0294055 12/1988 European Pat. Off. .
63-53091 10/1988 Japan .
2-286269 11/1990 Japan .
2151554 7/1985 United Kingdom .

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

A feeding and delivery structure for a cutform medium for use in a printer having a feeder positioned upstream of a platen, includes rollers disposed adjacent to the platen, a stacker having a curved bottom face member for storing delivered cutform media, guide plates positioned adjacent the feeder, and guide members slidingly attached to front faces of the guide plates, for guiding a manually fed cutform medium. The guide members form a surface of the stacker, and may have ribs formed thereon to decrease the carrying load of the cutform medium after it is conveyed through the rollers.

9 Claims, 2 Drawing Sheets

FEEDING AND DELIVERY STRUCTURE FOR CUTFORM MEDIA IN PRINTER

This is a continuation of application No. 07/803,040 filed Dec. 6, 1991 and now abandoned.

BACKGROUND INVENTION

The present invention relates to a feeding and delivery structure for a cutform medium (e.g., a single sheet or film) for use with a printer having an automatic feeder for cutform medira.

A conventional device, disclosed in Japanese Examined Patent Publication No. 63-53091 and as shown in FIG. 4 of the present application, has a cutform medium fed by an automatic feeder 101 disposed upstream of a platen 105, and conveyed by the platen and pressing rollers 106, 107. The cutform medium is printed by a printing head los opposed to the platen 105, delivered upwardly by delivery rollers 109, 110 and stored in a stacker 111. Such a printer is suitable for successive (e.g., continuous) processing of cutform media. However, when a single cutform medium different from those stored in the automatic feeder 101 is to be processed, the processing and handling thereof is troublesome. To eliminate this inconvenience, a sheet passage 112 for manual feeding and a manual feed guide 102 have been provided.

However, in the conventional feeding and delivery structure, the manual feed guide 102 for the cutform medium also serves as a rear face of the stacker adapted to store the cutform medium having been printed by the print head 108, and is located on the same plane as the printed cutform medium. Thus, a problem arises in that, if the cutform medium has a tendency to roll-up, a tip 104*a* of the cutform medium is rolled into the sheet passage 112 due to a rear or trailing end of the cutform medium remaining in the sheet passage.

Another problem in the conventional feeding and delivery structure is that the surface of the delivered cutform medium 104 is brought into contact with the rear face of the stacker. Therefore, when the cutform medium is electrostatically charged in a low humidity environment, the attraction of the cutform medium 104 to the stacker face increases. Hence, a comparatively thin cutform medium is buckled due to a force couple generated by the conveying force of the delivery rollers 109, 110 (e.g., indicated by arrow a in FIG. 4) and the carrying load on the rear face of the stacker (e.g., as indicated by arrow b), and cannot be properly conveyed by the delivery roller 109.

SUMMARY OF THE INVENTION

An object of the present invention is to solve the above-mentioned problems of the conventional device, and to provide a feeding and delivery structure for a cutform medium which enables the cutform medium to be safely and reliably delivered without being rolled into a sheet passage, even if it has a tendency to roll-up during its conveyance.

Another object of the present invention is to provide a feeding and delivery structure for a cutform medium which enables a comparatively thin cutform medium to be delivered reliably.

According to the invention, a feeding and delivery structure for a cutform medium in a printer, in which an automatic feeder for cutform media is disposed at a rear portion of a platen, includes delivery rollers disposed at upper portions of the platen, a stacker bottom face member provided at a rear portion of the delivery rollers and forming a stacker for storing delivered cutform media, and guide members slideably attached in the horizontal printing direction to front faces of guide plates provided at the front of the automatic feeder. The guide members guide the side edges and the front face of a manually fed cutform medium and have front faces forming a rear face of the stacker. The guide members may also have ribs formed on their front faces.

DETAILED DESCRIPTION OF THE PREFERRED EMBODIMENTS

Figure 1:
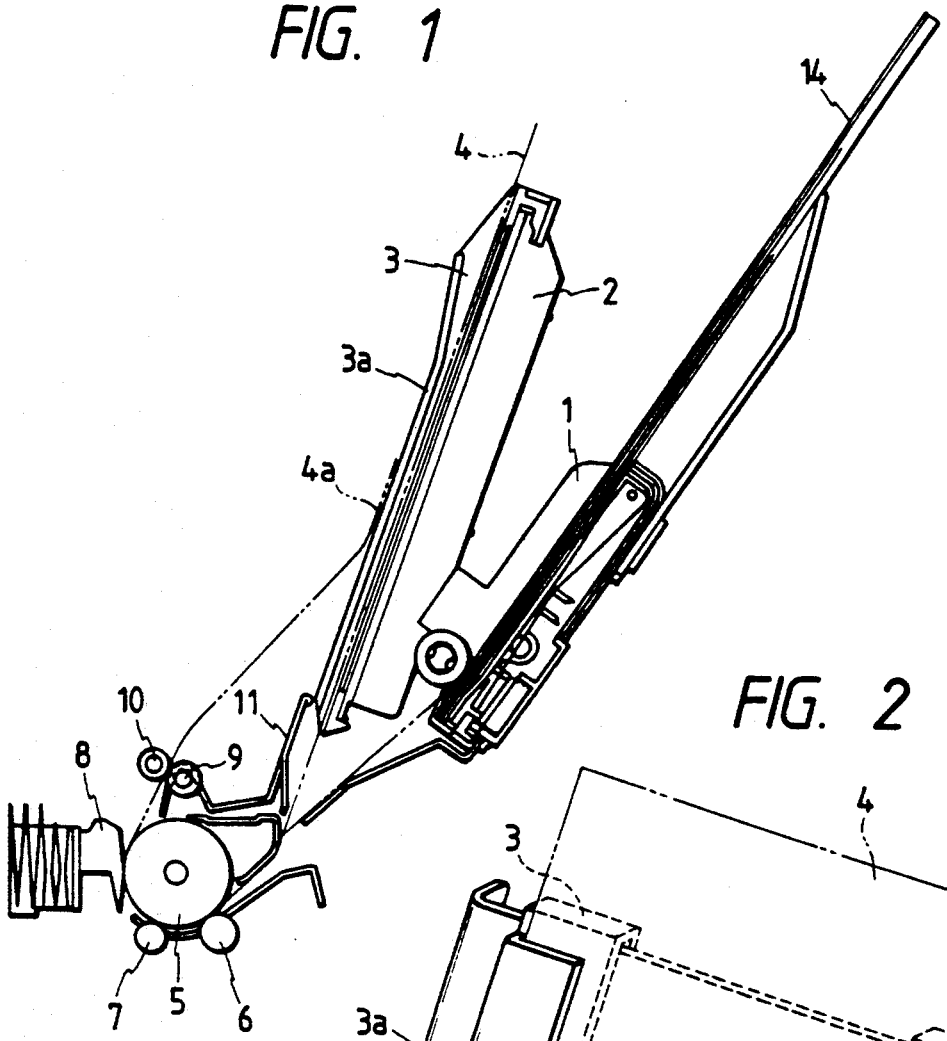
FIG. 1 is a sectional view of a feeding and delivery structure for a cutform medium according to a first embodiment of the present invention.
Figure 2:
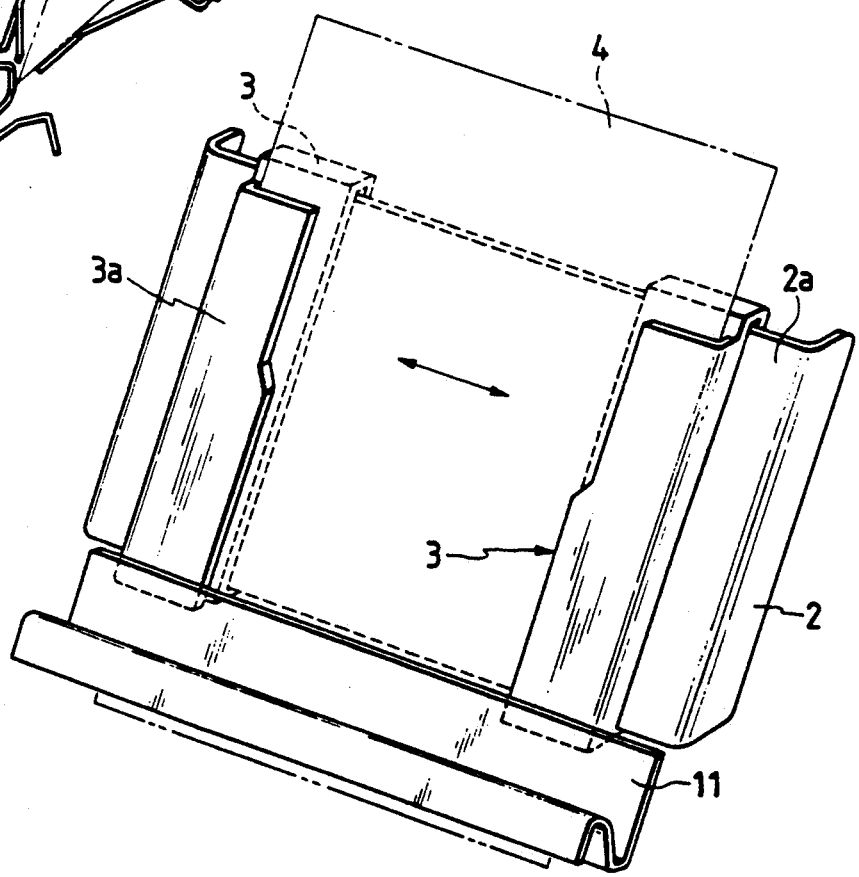
FIG. 2 is a partial perspective view of the feeding and delivery structure for a cutform medium of the first embodiment of the present invention.

In FIGS. 1 and 2, a cutform medium 14 fed by an automatic feeder 1 is conveyed by a platen 5 and pressing rollers 6, 7. Thereafter, the cutform medium 14 is printed by a printing head 8 opposed to the platen 5, passes between delivery rollers 9, 10 located above (e.g., upstream) the platen, and is delivered along front faces 3*a* of guide members 3 and stored in a stacker formed by a bottom face member 11 and the front faces 3*a* of the guide members. The bottom face member is secured at one end to a shaft supporting delivery roller 9.

When a cutform medium 4 different from that stored in the automatic feeder 1 is to be printed, the cutform medium 4 is manually fed, with its side edges and its front face being guided by the guide members 3 and front faces 2*a* of guide plate 2 disposed in front of the automatic feeder 1. The cutform medium 4 is guided to a normal position by guiding its edges. As can be seen in FIG. 2, the guide members 3 are slidable along the guide plate 2 to accommodate mediums of different widths. Similarly to when the cutform medium 4 is fed by the automatic feeder 1, it is subsequently carried and conveyed by the platen 5 and the pressing rollers 6, 7.

After the cutform medium is printed by the printing head 8, it passes between the delivery rollers 9, 10 located upstream of the platen 5 and is delivered along the front face portions 3*a* of the guide members. Even if the cutform medium 4 has a tendency to roll up due to its conveyance by the platen 5, since a sheet feed passage is separated from a sheet delivery passage by the guide members 3, an upper end 4*a* of the delivered cutform medium is prevented from rolling into the sheet feed passage again because of a cutform medium 4 remaining in the sheet feed passage. Thus, the delivered cutform medium can be stored reliably and easily in the stacker formed by the stacker bottom face member 11 and the front face portions 3*a* of the guide members.

Figure 3:
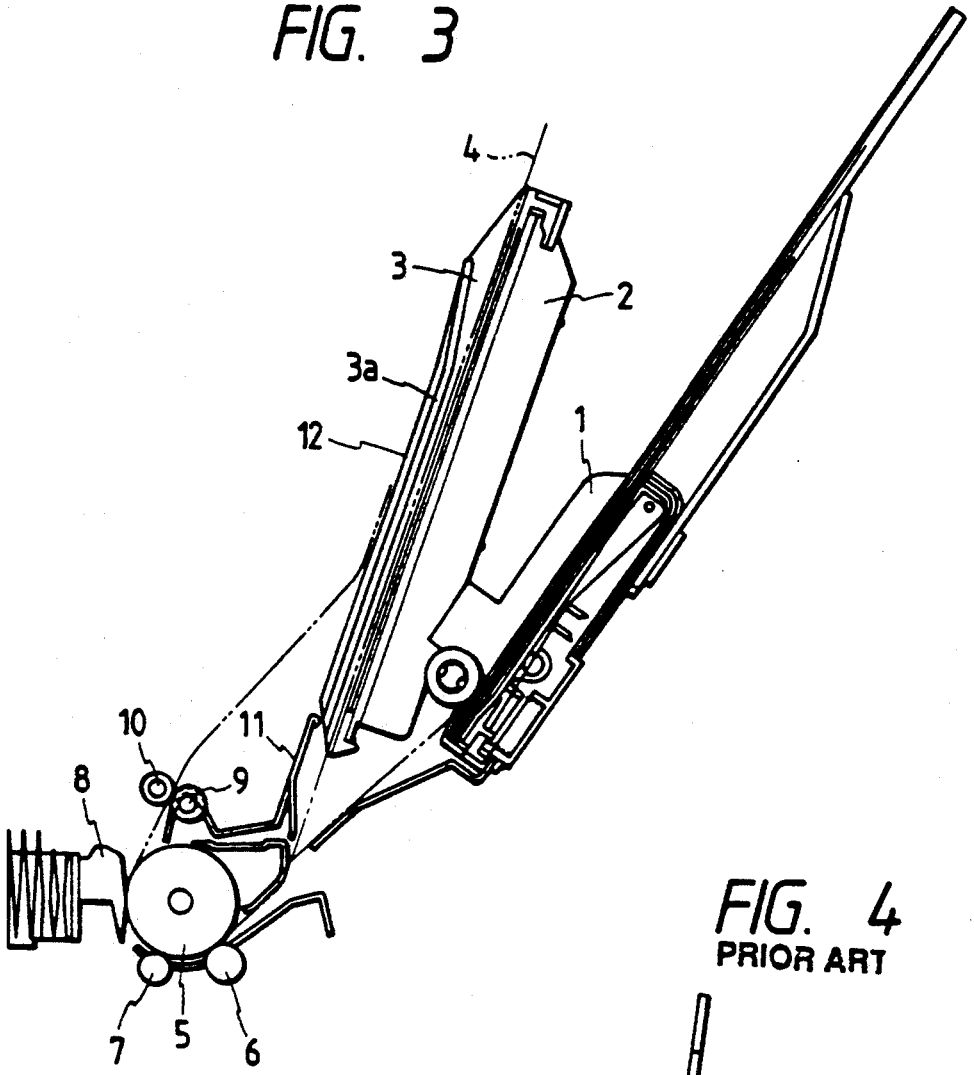
FIG. 3 is a sectional view of a second embodiment of the present invention.
Figure 4:
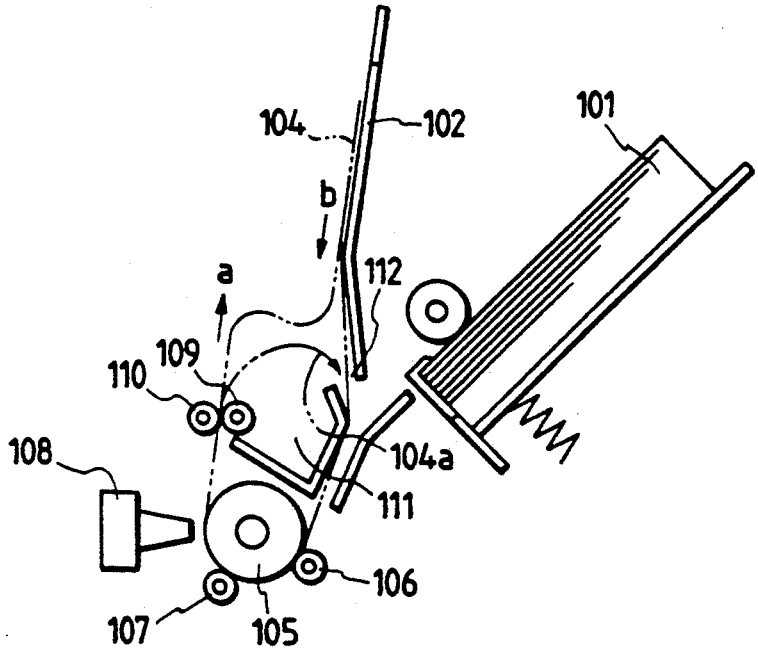
FIG. 4 PRIOR ART
FIG. 4 is a sectional view of a conventional feeding and delivery structure for a cutform medium.

Another embodiment of the invention, as shown in FIG. 3, illustrates a feeding and delivery structure for a cutform medium in which ribs 12 are formed on the front faces 3*a* of the guide members 3. As a result, after the cutform medium 4 passes between the delivery rollers 9, 10, the attraction of the cutform medium 4 carried along the guide members 3 to the stacker face is reduced since the frictional and electrostatic forces created (e.g., in a low humidity environment) are reduced. Thus, even in a low humidity environment, a comparatively thin cutform medium may be employed as compared to that of the conventional system, and a stable sheet feed operation may be performed.

According to the feeding and delivery structure for a cutform medium of the present invention, a manual sheet feed passage and a sheet delivery passage of the cutform medium are separated by guide members for guiding the edges and front face of the cutform medium, so that the cutform medium is prevented from rolling into the feed passage during the manual feeding thereof.

Furthermore, since the ribs are formed on the front faces of the guide members, a thinner cutform medium can be reliably delivered.

While certain preferred embodiments have been shown and described, many changes and modifications within the spirit of the invention will be apparent to those of working skill in this technical field. Thus, the scope of the invention should be considered as limited only by the appended claims.

What is claimed is:

1. A feeding and delivery structure for a cutform medium adapted for use with a printer having a platen and an automatic feeder for cutform media disposed upstream of said platen, comprising:

rollers disposed adjacent said platen for conveying said cutform medium;

a stacker for storing delivered cutform media conveyed by said rollers, said stacker including a bottom face member disposed downstream of said rollers;

a guide plate having a front face positioned at a first end of said automatic feeder; and a pair of guide members slidingly attached to said guide plate, said guide members each including a guide portion for receiving an guiding opposite lateral sides of a manually-fed cutform medium, a first planar portion for receiving and supporting a surface of said medium in a feeding condition and a second planar surface, disposed on an opposite side of said guide portion and forming a surface of said stacker, for receiving and supporting a surface of said medium in a discharged condition, said stacker being separated from said guide portion.

2. A feeding and delivery structure for a cutform medium according to claim 1, further comprising ribs formed on said guide members.

3. A feeding and delivery structure according to claim 1, wherein said rollers are disposed downstream of said plane.

4. A feeding and delivery structure according to claim 1, wherein said guide members are attached slidingly to said front faces of said guide plates, said guide members being slidable in a direction normal to a conveyance direction of said cutform medium.

5. A feeding and delivery structure according to claim 3, wherein said rollers comprise delivery rollers.

6. A feeding and delivery structure according to claim 1, wherein said cutform medium has a sheet feed passage and a sheet delivery passage, said guide members separating said sheet feed passage of said cutform medium from said sheet delivery passage.

7. A feeding and delivery structure according to claim 1, wherein a first end of a delivered cutform medium is prevented from rolling into a sheet feed passage of said cutform medium by a subsequent cutform medium remaining in said sheet feed passage.

8. A feeding and delivery structure according to claim 2, wherein said ribs are formed on said front faces of said guide members, said ribs reducing an attraction of said cutform medium to said stacker after said cutform medium is conveyed by said rollers.

9. A feeding and delivery structure for a cutform medium adapted for use with a printer having a platen and a feeder positioned adjacent thereto, comprising:

rollers positioned adjacent to said platen for conveying said cutform medium;

a stacking member for receiving and stacking cutform media conveyed by said rollers, said stacking member including a member having an angular shape positioned adjacent to said rollers for supporting said cutform medium;

a guide plates provided adjacent to said feeder; and a pair of guide mechanisms slidingly attached to said guide plates for respectively guiding opposite lateral sides of a manually fed cutform medium, said guide mechanisms including a first planar portion for receiving and supporting a surface of said medium in a feeding condition and a second coplanar surface for receiving and supporting a surface of said medium in a discharged condition, said guide mechanisms forming a surface of said stacking member.

* * * * *